US010800633B2

(12) United States Patent
Troxler

(10) Patent No.: US 10,800,633 B2
(45) Date of Patent: Oct. 13, 2020

(54) APPARATUS AND METHOD FOR THE POST-PROCESSING OF SEQUENTIALLY PRINTED SHEETS

(71) Applicant: MÜLLER MARTINI HOLDING AG, Hergiswil (CH)

(72) Inventor: Christian Troxler, Rain (CH)

(73) Assignee: MÜLLER MARTINI HOLDING AG, Hergiswil (CH)

( * ) Notice: Subject to any disclaimer, the term of this patent is extended or adjusted under 35 U.S.C. 154(b) by 0 days.

(21) Appl. No.: 16/285,523

(22) Filed: Feb. 26, 2019

(65) Prior Publication Data

US 2019/0263622 A1 Aug. 29, 2019

(30) Foreign Application Priority Data

Feb. 28, 2018 (CH) ..... 241/18

(51) Int. Cl.
*B65H 37/06* (2006.01)
*B31F 5/00* (2006.01)
(Continued)

(52) U.S. Cl.
CPC ..... *B65H 37/06* (2013.01); *B31F 5/005* (2013.01); *B41F 13/54* (2013.01); *B41F 13/56* (2013.01);
(Continued)

(58) Field of Classification Search
CPC ..... B31F 5/005; B65H 29/68; B65H 29/145; B65H 29/247; B65H 31/02; B65H 37/06;
(Continued)

(56) References Cited

U.S. PATENT DOCUMENTS 3,229,973 A * 1/1966 Cornwall ..... D06F 89/00 493/418
3,616,069 A * 10/1971 Schwalbach ..... B29D 30/38 156/444
(Continued)

FOREIGN PATENT DOCUMENTS

DE 2727869 A1 5/2014
DE 102016203043 A1 8/2017
(Continued)

OTHER PUBLICATIONS

International Search Report for Swiss Patent Application No. 2412018 dated Jun. 12, 2018 (with English translation).

*Primary Examiner* — Leslie A Nicholson, III
(74) *Attorney, Agent, or Firm* — FisherBroyles, LLP; Robert Kinberg

(57) ABSTRACT

An apparatus and method for the post-processing of successively following, sequentially printed sheets, includes a conveyor, a folding table, a folding sword, a folding roller pair, at least one pressing-down mechanism, and a machine control that is operatively connected to the folding sword and the pressing-down mechanism. The pressing-down mechanism includes at least one mechanical braking element which acts in the region of the back edge onto the top side of the printed sheet to be positioned on the folding table. The stationary folding sword includes a compressed-air device with at least one outlet opening for compressed air which is focused onto a folding roller gap. The folding table forms a gathering device for at least two successively following printed sheets. A sensor, arranged in a region of the conveyor, is operatively connected to the machine control and functions to detect the printed sheets, transported with the conveyor.

28 Claims, 3 Drawing Sheets

(51) Int. Cl.

| | |
|---|---|
| ***B65H 31/02*** | (2006.01) |
| ***B65H 39/10*** | (2006.01) |
| ***B65H 43/00*** | (2006.01) |
| ***B65H 29/14*** | (2006.01) |
| ***B41F 13/54*** | (2006.01) |
| ***B65H 29/68*** | (2006.01) |
| ***B41F 13/56*** | (2006.01) |
| ***B65H 45/18*** | (2006.01) |
| ***B65H 29/24*** | (2006.01) |

(52) U.S. Cl.
CPC ..... *B65H 29/145* (2013.01); *B65H 29/247* (2013.01); *B65H 29/68* (2013.01); *B65H 31/02* (2013.01); *B65H 39/10* (2013.01); *B65H 43/00* (2013.01); *B65H 45/18* (2013.01); *B65H 2301/4212* (2013.01); *B65H 2301/4213* (2013.01); *B65H 2701/18264* (2013.01)

(58) Field of Classification Search
CPC ..... B65H 39/10; B65H 43/00; B65H 45/18; B65H 2301/4212; B65H 2301/4213; B65H 2701/18264; B41F 13/54; B41F 13/56
USPC ..... 270/32, 45; 493/418, 450
See application file for complete search history.

(56) References Cited

U.S. PATENT DOCUMENTS

| | | | | |
|---|---|---|---|---|
| 3,773,315 | A * | 11/1973 | Tsien | B29C 53/04 493/443 |
| 4,053,150 | A * | 10/1977 | Lane | B65H 45/18 493/417 |
| 6,840,616 | B2 * | 1/2005 | Summers | B65H 45/18 101/232 |
| 8,708,326 | B2 | 4/2014 | Egli et al. | |
| 9,650,224 | B2 | 5/2017 | Braschoss et al. | |
| 9,708,150 | B2 | 7/2017 | Braschoss et al. | |
| 9,969,155 | B2 | 5/2018 | Duss et al. | |
| 9,969,156 | B2 * | 5/2018 | Duss | B65H 29/686 |

FOREIGN PATENT DOCUMENTS

| | | | |
|---|---|---|---|
| EP | 2502862 | A1 | 9/2012 |
| EP | 2727868 | A1 | 5/2014 |
| EP | 2818331 | A2 | 12/2014 |
| EP | 3002240 | A1 | 4/2016 |
| EP | 3002241 | A1 | 4/2016 |
| WO | 95/18057 | A1 | 7/1995 |

* cited by examiner

APPARATUS AND METHOD FOR THE POST-PROCESSING OF SEQUENTIALLY PRINTED SHEETS

CROSS-REFERENCE TO RELATED APPLICATIONS

This application claims priority to Swiss Application No. 00241/18 filed Feb. 28, 2018, the disclosure of which is incorporated herein by reference in its entirety.

BACKGROUND OF INVENTION

The invention relates to an apparatus and a method for the post-processing of sequentially printed sheets that follow each other. The apparatus comprises a conveyor for transporting the printed sheets in a conveying direction, a folding table arranged in a downstream region of the conveyor for accommodating the printed sheets, a folding sword positioned at a vertical distance to the folding table, a pair of folding rollers with a gap in-between, which are arranged on the side opposite the folding sword, at least one pressing-down mechanism arranged above the folding table in upstream direction of said table and used for pressing down a back edge of a printed sheet positioned on the folding table in the direction of the folding table, wherein a front edge of a following printed sheet is supplied while raised up, relative to the back edge of the printed sheet positioned on the folding table, as well as a machine control, operatively connected to the folding sword and the at least one pressing down mechanism.

For the method, the sequentially printed sheets that follow each other are transported by the conveyor in conveying direction to the folding table, positioned in a downstream region of the conveyor, and are deposited thereon, wherein the folding sword that is arranged at a vertical distance to the folding table and the folding roller pair, with in-between gap is positioned on a side of the folding table that is opposite the folding sword and wherein these cooperate for the folding of the printed sheets, wherein the back edge of a preceding printed sheet positioned on the folding table is pressed down in the direction of the folding table with at least one pressing down mechanism, and wherein the front edge of the following printed sheet is supplied while raised up, relative to the back edge of the preceding printed sheet already positioned on the folding table, and wherein the pressing down mechanism and the folding sword are controlled with the aid of a machine control.

The sequentially printed sheets can be non-folded and/or folded printed sheets that are supplied inline, meaning directly or indirectly, following a digital printing press. An offline supply is alternatively also possible, meaning starting with a printed-on material web in an intermediate storage, from which printed sheets are subsequently cut and, if applicable, are folded, or the sheets can be supplied from an intermediate storage location containing non-folded and/or folded printed sheets.

With the digital printing, the print image is transferred from a computer directly to the printing press, without the use of static print forms. For this, the material web can be printed on in the sequence specified for the finished print product, meaning sequentially, in dependence on the predetermined folding pattern. Relatively small peace numbers up to a single print product can be realized in this way. In the process and in contrast to traditional printing methods, such as the offset printing, successively following printed sheets are frequently encountered, which have different characteristics, for example the print itself, the number of printed pages on each printed sheet, and the respective format.

Finally, digital printing presses nowadays print larger and larger amounts of material per time unit. Regardless of whether the digital printing presses process material webs or individual printed sheets, large amounts of print material must subsequently be processed further. Owing to the large material throughput, high transporting speeds occur which make careful post-processing of the printed sheets more difficult. Depending on the machines used for the post processing, gaps must be formed between the printed sheets which further increases the transporting speed. Also, blank pages in a print product are less and less acceptable nowadays because of the technical possibilities of the digital printing.

Downstream of the digital printing press, the transporting speed for the printed sheets cut from the material web, or also the sheets printed individually in the digital printing press, can be reduced through the longitudinal and/or cross-folding of these once or several times with known devices. To be sure, the folding on the one hand allows for a more careful post-processing of the printed sheets, but each folding operation also potentially leads to an undesirable increase of blank pages, which can be avoided by using previously not folded printed sheets. However, this increases the transporting speed, resulting in a high number of cycles, depending on the post-processing machines used, and can a make a careful further processing more difficult again as well as result in quality problems.

An apparatus and a method are known from European patent document EP2818331 A2 for the inline post-processing of a paper web which is sequentially printed-on by a digital printing press. The printed-on paper web initially moves through a perforating and cutting station. The printed sheets cut off in this station are respectively folded once or several times with cross-folding and longitudinal folding devices. After the folding, the printed sheets which later on form a joint book block are gathered overlapping in a gathering device before being stacked in a following stacking device and provided with adhesive to form a book block. The book blocks are subsequently transported to different processing devices.

With this solution, a certain reduction in the number of blank pages can be achieved depending on the use number, owing to the fact that folding patterns are optimized automatically in the machine control, based on the respective production orders. However, the cost, the space requirement and the control and adjustment expenditure are relatively high because of the number of processing stations. Depending on the operational mode for this apparatus, the transporting speed following the cutting is also relatively high for the printed sheets which are transported individually, with short spacing in-between, so that quality problems can occur during the post-processing.

European patent document EP2502862 A1 discloses an apparatus and a method for processing printed sheets having different formats, which were previously cut from a material web imprinted by a digital printing press. The apparatus is provided with at least two gathering drums, arranged one above the other, for processing successively following printed sheets with different formats. During the operation of the apparatus, a partial stack of three printed sheets is created downstream of the gathering drums, for example by combining two printed sheets having different formats with a third printed sheet, which partial stack can subsequently be combined with a different partial stack to form a print product. For this, the partial stacks can initially be folded lengthwise or crosswise downstream of where they are formed.

Owing to the forming of partial stacks with the two gathering drums, the transport speed for the partial stacks can favorably be reduced with this solution downstream of the print post-processing device. However, it requires a relatively involved drive for the two gathering drums, for example using a coupling gear, or two coordinated separate drives. A reduction in the number of blank pages is not disclosed.

European patent documents EP2727868 A1 and EP2727869 A1 respectively disclose an apparatus and a method for the longitudinal or cross folding of sequentially printed sheets with the aid of a digital printing press. The respective apparatus is provided for this with a compressed-air device having several exit openings for the compressed air, which is connected to a compressed-air source and a control unit. With these solutions, relatively high transport speeds and thus high capacities can be realized. Owing to the high transport speeds, however, quality problems can occur in some instances during the folding of printed sheets following each other with relatively short spacing. To avoid a collision between the back edge of a leading printed sheet and the front edge of a trailing printed sheet during the longitudinal folding, the leading printed sheet must always first be conveyed out of the folding rollers and/or moved below the plane of the folding table before the trailing printed sheet can be supplied. However, only successively following, individual printed sheets can be folded with these solutions.

A folding machine with a sword-folding station for folding successively following, individual printed sheets is disclosed in German patent document DE 102016203043 A1. Such machine comprises at least one folding sword that can be lowered and raised and a folding roller pair arranged below the folding sword. The folding sword comprises a mechanical sword blade and, as an extension thereof, a pneumatic sword blade arranged directly upstream, wherein the latter comprises at least one nozzle for generating blast air. The folding machine is furthermore provided with a downstream arranged mechanical end stop for stopping the front edge of the printed sheet inserted into the sword-folding machine, an upstream positioned pneumatic pressing-down mechanism for the back edge of this printed sheet, as well as a guide element arranged further upstream for lifting up a following printed sheet when entering the sword-folding station. The printed sheets are arranged on circulating transporting belts and are transported with these belts through the folding machine.

During the folding machine operation and corresponding to the pending production orders, printed sheets are successively supplied to the sword-folding station and are respectively folded individually in longitudinal direction through a joint operation of the folding sword and the folding rollers. The printed sheets folded in this way are then conveyed away in downward direction for the further processing. As a result of the two-part folding sword with the pneumatic sword blade arranged in upstream direction, a following printed sheet can thus be supplied to the sword-folding station immediately after the folding of the preceding printed sheet which is still partially located on the transport belts, without danger of the following printed sheet colliding with the folding sword. With this, a higher folding capacity can be achieved at the same transport speed, or the transport speed can be reduced while the folding capacity remains the same. Shortly before the front edge of the following sheet reaches the back edge of the preceding sheet, a pressing force is applied by the pneumatic pressing-down mechanism onto the back edge of the preceding printed sheet. Immediately thereafter, the following printed sheet is lifted up along its front edge via the guide element. Through the combination of pressing-down and lifting up, a collision between the two sheets can be prevented. The air impulse from the pneumatic pressing-down mechanism in combination with the transport belt air and pneumatic pressing-down elements, arranged on both sides and above the folding table, or in combination with corresponding mechanical pressing-down mechanisms, ensures that the printed sheet is pressed with friction against the transport belts and, in the process, assumes the transport speed and is transported defined to the end stop.

Despite the increase in capacity that occurs, this folding machine is only intended for relatively low transport speeds. Additional capacity increases are thus hardly possible. In addition, the end stop is suitable only for low transport speeds because a printed sheet arriving at this end stop with high speed is damaged and/or can bounce back. Finally, this folding machine is only suitable for the folding of successively arriving, individual printed sheets.

European patent document EP3002240 A1 relates to a device for braking and positioning a printed sheet in a processing machine, for example printed-on in a digital printing press, as well as a method for operating such a device. With this device, individual printed sheets moving at a high transport speed can be braked completely during a very short time interval in a stable, precise position without danger of being damaged. A mechanical folding sword is used, however, to which each printed sheet is supplied in the same plane in which it was positioned prior to the folding operation. To position a following printed sheet on the folding table, the preceding printed sheet must have been pulled far enough off the folding table, so that its trailing end is located below the feeding plane for the following printed sheet. This results a in relatively high speed for withdrawing the individual printed sheets from the folding table and moving them into the folding roller pair. Under some conditions that can result in quality problems during the further processing, meaning the folding over of the trailing ends of a printed sheet and the forming of so-called dog ears. There is also the danger of a collision between a following printed sheet and the mechanical folding sword. Finally, the fixed movement course of the mechanical folding sword cannot be changed to handle successively following but different printed sheets, making this solution suitable only for folding successively following, individual printed sheets.

SUMMARY OF THE INVENTION

It is therefore an object of the invention to provide a simple and cost-effective apparatus and a corresponding method for the post-processing of sequentially printed sheets with a digital printing press, wherein the transport speed for the printed sheets can be reduced while making it possible to achieve an improvement in the capacity. A careful further processing of the printed sheets should also be possible, thus avoiding quality problems, as well as a potential reduction in the number of blank pages in the finished product.

The above and other objects are achieved with an apparatus for the post-processing of successively following, sequentially printed sheets, which in one embodiment comprises: a conveyor for transporting printed sheets in a conveying direction; a folding table, arranged in a downstream region of the conveyor, for accommodating the printed sheets, the folding table constructed and arranged as a gathering device for at least two successively following printed sheets; a folding sword arranged at a vertical distance to the folding table, wherein the folding sword is arranged to be stationary and comprises a compressed-air device that is connectable to a first compressed air source and has at least one outlet opening; a folding roller pair with an in-between arranged folding roller gap, the roller pair being arranged on a side of a folding table that is opposite a side on which the folding sword is located, wherein the outlet opening of the compressed air device is focused on the folding roller gap for introducing compressed air to fold the printed sheets; at least one pressing-down mechanism, positioned above the folding table and in an upstream region of the folding table, for pressing down in the direction of the folding table a back edge of a printed sheet to be positioned on the folding table, wherein a front edge of a following printed sheet is supplied while raised up, relative to the back edge of the printed sheet positioned on the folding table; and wherein the at least one pressing down mechanism includes at least one mechanical braking element for the printed sheets which acts upon a top side of at least one printed sheet to be positioned on the folding table; a machine control operatively connected to the folding sword and the at least one pressing-down mechanism; and at least one sensor arranged in a region of the conveyor which cooperates with the machine control for detecting the printed sheets conveyed with the conveyor.

Accordingly, the at least one pressing-down mechanism in the above embodiment of the apparatus according to the invention is provided with a mechanical braking element acting upon the top side of the printed sheet, at least in the region of the back edge of the printed sheet to be positioned on the folding table. The folding sword is furthermore embodied stationary and comprises a compressed-air line, connected to a first compressed-air source, and has at least one outlet opening directed toward the folding roller gap for introducing the compressed air used for folding the printed sheet. The folding table furthermore forms a gathering device for at least two successively following printed sheets. Finally, at least one sensor is arranged in the region of the conveyor, which sensor is operatively connected to the machine control and functions to detect the printed sheets conveyed with the conveyor.

According to another aspect of the invention there is provided a method for post-processing of successively following, sequentially printed sheets, comprising: transporting by a conveyor the successively following, sequentially printed sheets in a conveying direction to a folding table arranged in a downstream region of the conveyor; depositing the transported printed sheets on the folding table; operating jointly for folding the printed sheets a folding sword positioned at a vertical distance to the folding table and a folding roller pair with an in-between formed folding gap positioned on a side of the folding table that is located opposite the folding sword, wherein the folding sword is stationary and has at least one outlet opening for blowing compressed air; pressing down a back edge of a preceding printed sheet to be positioned on the folding table with at least one pressing-down mechanism in a direction of the folding table for braking the preceding printed sheet, wherein the pressing down mechanism includes a mechanical braking element making contact with a top side of the preceding printed sheet in a region of a back edge of the preceding printed sheet; supplying a following printed sheet with a front edge of the following print sheet raised up, relative to the back edge of the preceding printed sheet positioned on the folding table; controlling the pressing-down mechanism and the folding sword via a machine control; gathering at least two successively following printed sheets on a gathering device of the folding table to form a joint stack; folding the joint stack into a print product by compressed air from a first compressed-air source blown onto the joint stack through the at least one outlet opening in the stationary folding sword; detecting a printed sheet transported with the conveyor by a sensor which is operatively connected to the machine control; computing with the machine control corresponding control signals based on information obtained from the sensor for pressing down the back edge of the preceding printed sheet with the pressing down mechanism for braking the printed sheet by the mechanical braking element and for triggering activation of the folding sword for carrying out the folding step; and triggering the pressing down, braking, and folding with the control signals.

Thus, with the method according to the above embodiment, at least two successively following printed sheets are gathered on the gathering device of the folding table to form a joint stack, and the stacked sheets are folded jointly to form a print product. A leading printed sheet to be positioned on the folding table in the process is braked in the top region of its back edge through contact with the mechanical braking element. The stack folding is triggered by blowing compressed air from the first compressed-air source onto the stack, through the at least one outlet opening in the stationary folding sword. A printed sheet transported with the conveyor is furthermore detected with the at least one sensor that is operatively connected to the machine control. Based on the information obtained from the sensor, the machine control computes corresponding control signals for pressing down the back edge of the preceding printed sheet, for braking the sheet and operating the folding sword and then triggers the pressing down, the braking, and the folding operations.

With the folding machine known from the prior art, only successively following, individual printed sheets can be processed because a second printed sheet, deposited on the first printed sheet, could not be pressed against the transport belts but only against the first printed sheet already resting with its front edge against the end stop. A second printed sheet therefore could no longer be transported cleanly to the end stop. A folding machine of this type is therefore not suitable for gathering printed sheets and the subsequent folding operation.

In contrast thereto, the apparatus and method according to the invention can be used not only for folding successively following, individual printed sheets, but also for folding sheets that were previously gathered into a stack. As a result, the transport speed for the printed sheets gathered into a stack can advantageously be reduced during the folding and also following the folding operation, as compared to individually supplied and folded printed sheets. In addition to an improved capacity, it also results in a simple, compact and cost-effective apparatus as well as a corresponding method. With a lower operational risk, the method allows realizing a more careful post-processing of the printed sheets and a better quality of the folded print products. Finally, when supplying non-folded printed sheets to the folding table, meaning during the stack forming using the non-folded sheets, a reduction of blank sheets can be achieved. A post-processing or further processing with the inventive apparatus and the inventive method is understood to refer mainly to the feeding of individual printed sheets to the folding table, the gathering of these printed sheets on the folding table, and the subsequent folding of the stacks formed with the gathered printed sheets.

For one embodiment of the inventive apparatus, an end stop is arranged in the region of the folding table for the front edges of the printed sheets to be gathered on the folding table. The front edges of the printed sheets to be gathered on the folding table are conveyed according to one embodiment of the inventive method against an end stop located in the folding table region. An improved orientation of the printed sheets in the stack and thus also improved quality can be achieved in this way.

A different embodiment of the inventive apparatus provides that the end stop is embodied movable in and counter to the conveying direction. A different embodiment of the inventive method calls for the end stop to be moved in or counter to the conveying direction if the printed sheets to be gathered on the folding table have different formats. In this way, the apparatus can be adapted cost-effectively and simply to printed sheets with different formats.

According to another embodiment of the inventive apparatus, the at least one pressing-down mechanism is connected to the first or to a second compressed-air source and is provided with at least one compressed air exit opening that is directed toward the top printed sheet to be positioned on the folding table, in the region of its back edge. The at least one mechanical braking element in that case is arranged between the at least one first exit opening in the pressing-down mechanism and the folding table. According to a corresponding embodiment of the inventive method, the at least one pressing-down mechanism is supplied with compressed air by the first compressed-air source or by a second compressed-air source, and the compressed air flows out through at least one exit opening in the pressing-down mechanism and onto the top side of the printed sheet positioned on the folding table, in the region of its back edge. The compressed air leaving the at least first one first exit opening in the pressing-down mechanism is conducted onto the at least one mechanical braking element, which is then deflected in the direction of the folding table and comes in contact with the printed sheet to be positioned on the folding table or to be supplied to the stack. A simple, cost-effective and very quickly responding solution is thus obtained, which furthermore comprises barely moving components, meaning there is little wear and tear.

A different embodiment of the inventive apparatus is provided with at least two separate pressing-down mechanisms, which are respectively arranged transverse to the conveying direction for the printed sheets, at a distance to the side from a folding sword that is positioned at the upstream end of the compressed-air device. According to the corresponding inventive method, the compressed air flows out via the at least two separate pressing-down mechanisms. In this way, the printed sheets can advantageously be held down and braked uniformly and without the danger of turning.

Yet another embodiment provides that the distance is adjustable at which the at least two separate pressing-down mechanisms are positioned on the side. Based on the corresponding inventive method, the side spacing for the at least two separate pressing-down mechanisms can thus be reduced or increased for a following order to process printed sheets having smaller or larger formats. The pressing-down mechanisms can thus be adjusted to fit the format of the printed sheets to be gathered on the folding table. The complete back edge of the respective printed sheet can thus be pressed down in the direction of the folding table, so that no regions of the printed sheet can collide with a following printed sheet.

According to a different embodiment of the inventive apparatus, the folding sword comprises a number of segments, arranged successively in conveying direction. For the corresponding inventive method, the compressed air supplied by the first compressed-air source is introduced into the folding sword segments, wherein only the segments in the region of the stack are admitted with compressed air with the aid of the machine control. Owing to the design with separate segments, these can be controlled separately, and the format of the stack positioned on the folding table can thus be admitted targeted with compressed air. In addition, eddying of the compressed air in the empty space between the folding sword and the stack to be folded can be prevented, thus avoiding problems with the correct orientation of the top printed sheet in the stack.

According to a different embodiment of the inventive apparatus, the conveyor has a lower belt and an upper belt which jointly operate for transporting the printed sheet. With the corresponding inventive method, the printed sheets are transported to the folding table inside a conveying gap, formed between the upper and the lower belt of the conveyor. As a result, the printed sheets are clamped during the transport into the conveying gap and can be accelerated or braked without slipping.

Corresponding to another embodiment of the inventive apparatus, both the lower belt and the upper belt extend into the region of the folding table. According to the corresponding inventive method, the printed sheets are transported with the upper belt and the lower belt of the conveyor into the region of the folding table. Owing to this arrangement, the lower belt can transport the lowest printed sheet in the stack to be formed against the end stop and position it correctly thereon, while the upper belt can guide and/or move the printed sheets onto the folding table. In addition, only one drive is respectively needed for the upper belt and the lower belt.

Based on another embodiment of the inventive apparatus, the upper belt and/or the lower belt are embodied so as to converge toward each other in the region of the folding table. With the corresponding inventive method, the guidance of the printed sheets in the region of the folding table is additionally supported with this converging design for the lower and/or the upper belt.

Another embodiment of the inventive apparatus provides for at least two sensors in the region of the conveyor, which are operatively connected to the machine control, are positioned spaced-apart and transverse to the conveying direction, for detecting the printed sheets transported with the conveyor. With the corresponding inventive method, the printed sheets are detected in the conveyor region via the at least two sensors, thus making it possible to identify a possible slanted positioning of a transported printed sheet and, for example, correct this problem through correspondingly admitting the segments of the sword or the pressing-down mechanism with compressed air.

According to yet another embodiment of the inventive apparatus, the folding roller pair and the folding sword are arranged in lengthwise or cross direction to the conveying direction. With this solution, the stack can advantageously be folded in transverse as well as longitudinal direction, relative to the printed sheets conveyed on the conveyor. If the folding roller pair and the folding sword are arranged transverse to the conveying direction, the pressing-down mechanisms are arranged parallel thereto.

A different embodiment of the inventive apparatus is designed to have an adjustable width for the folding roller gap. With the corresponding inventive method, the gap width is correspondingly adjusted for a following processing order having a different thickness for the stack to be folded. The folding roller gap can thus be advantageously adapted to processing orders with different stack thicknesses, using a corresponding relative movement for the positioning of the folding rollers. Alternatively, the folding rollers can also be embodied spring-loaded and can thus compensate for different thicknesses within certain tolerance ranges.

BRIEF DESCRIPTION OF THE DRAWINGS

In the following, the invention is described in further detail together with accompanying drawings, with the aid of exemplary embodiments, wherein.

DETAILED DESCRIPTION OF THE INVENTION

Figure 1:
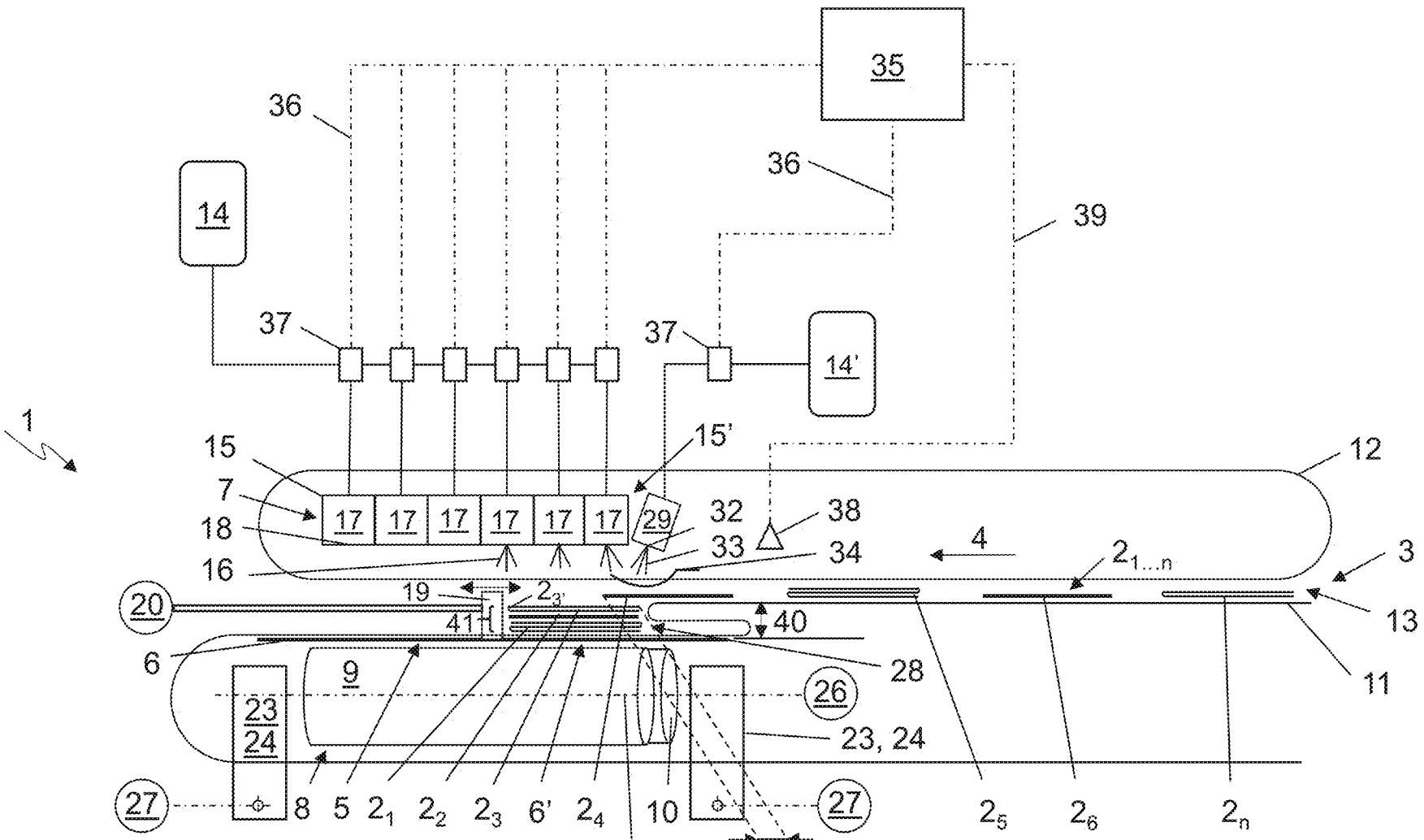
FIG. 1 is schematic view from the side of an inventive apparatus for the post-processing of printed sheets according to a first exemplary embodiment.
Figure 2:
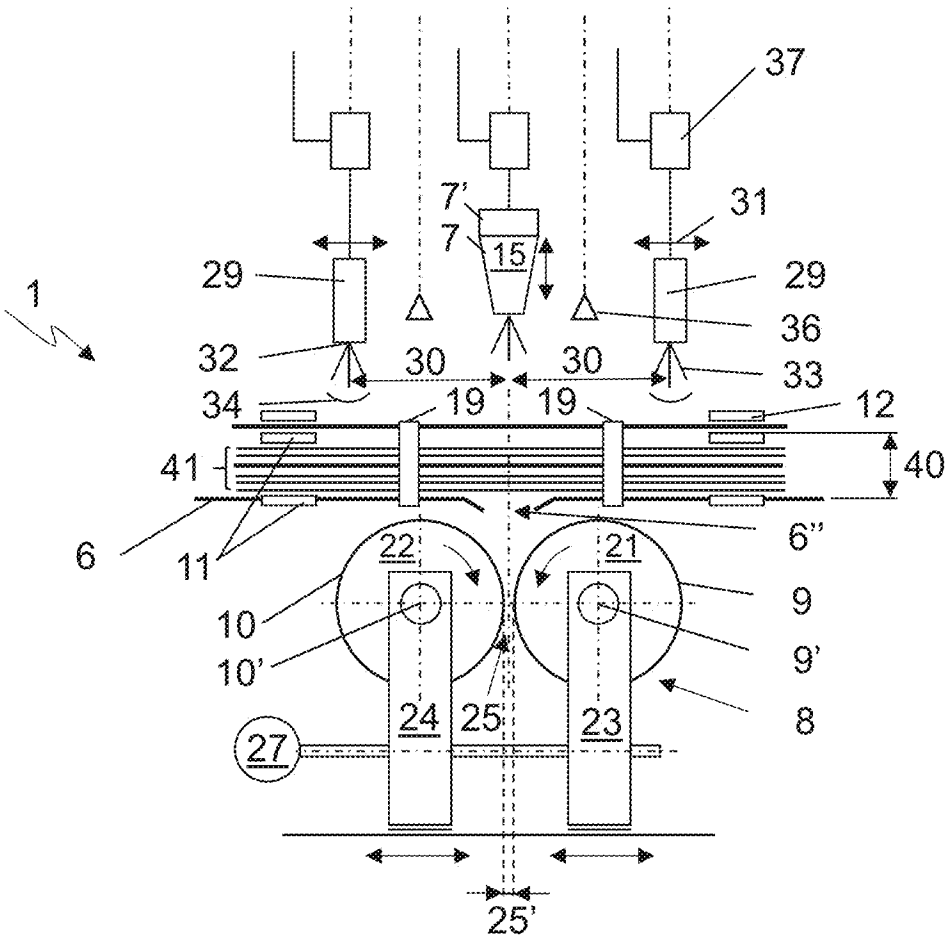
FIG. 2 is a simplified schematic view from the front of the inventive apparatus according to the first exemplary embodiment, shown counter to the conveying direction for the printed sheets.

FIG. 1 shows in a first exemplary embodiment a schematic view from the side of an inventive apparatus 1 for the post-processing of printed sheets $\mathbf{2}_{1 \ldots n}$, printed sequentially with a non-depicted digital printing press. A shown, the printed sheets $\mathbf{2}_{1 \ldots n}$ can be non-folded, folded once, or folded several times and can be supplied to the apparatus 1 in a random sequence. The apparatus 1 comprises a conveyor 3 for transporting the printed sheets $\mathbf{2}_{1 \ldots n}$, here the printed sheets $\mathbf{2}_4$, $\mathbf{2}_5$, $\mathbf{2}_6$ and $\mathbf{2}_n$, in a conveying direction 4. The machine also comprises a folding table 6 arranged in a downstream region 5 of the conveyor 3, a folding sword 7 arranged above the folding table 6 in a central position and transverse to the conveying direction 4, as well as a folding roller pair 8 arranged below the folding table 6 and comprising a first folding roller 9 and parallel thereto a second folding roller 10. The folding sword 7 is here provided with and is mounted on a height-adjustable holding element 7' (FIG. 2). Of course, the folding sword 7 can also be arranged below the folding table 6 and the folding roller pair 8 correspondingly arranged above the folding table if necessary. In general, the folding sword 7 is thus arranged at a vertical distance to the folding table 6 and the folding roller pair 8 is also positioned at a vertical distance to the folding table 6, but on the side opposite the folding sword 7.

Figure 3:
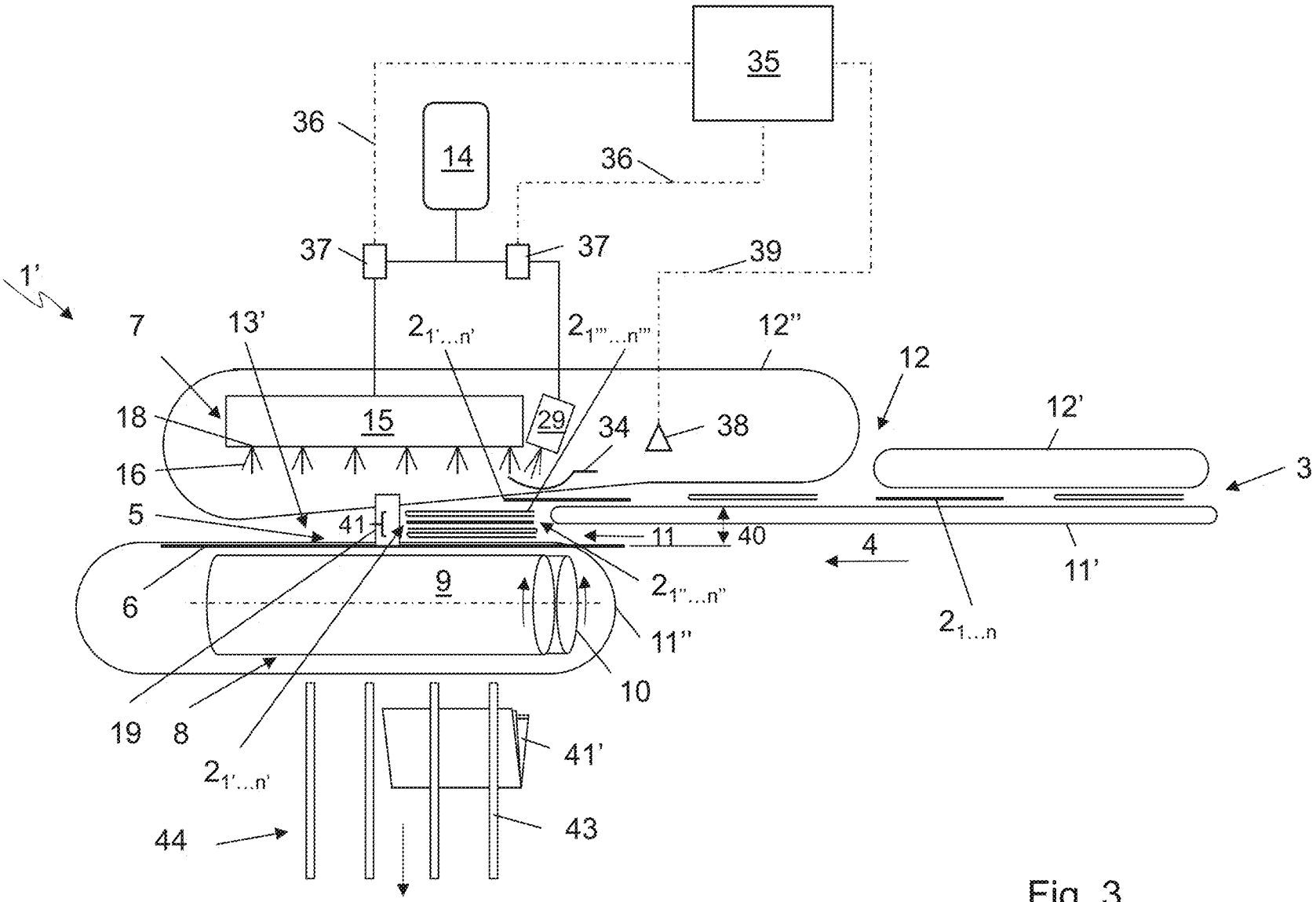
FIG. 3 is a schematic view from the side of an inventive apparatus for the post-processing of printed sheets according to a second exemplary embodiment.

The conveyor 3 is composed of a lower belt 11, consisting of several individual belt sections, arranged parallel and spaced-apart transverse to the transporting direction, which are not shown herein, as well as an upper belt 12, extending parallel thereto and operating jointly with the lower belt 11, wherein a conveying gap 13 for the printed sheets $\mathbf{2}_{1 \ldots n}$ formed between these belts. The lower belt 11 as well as the upper belt 12 extend into the region of the folding table 6. Of course, the lower belt 11 and the upper belt 12 can also be embodied converging toward each other in that region, so that a continuously narrowing conveying gap 13' results in the region of the folding table 6 (FIG. 3).

The folding sword 7 is embodied stationary and comprises a compressed-air device 15 that is connected to a first compressed-air source 14, with several "s 17 (FIG. 1), which are arranged sequentially in conveying direction 4 and are supplied separately with compressed air 16. Each segment 17 comprises at least one outlet opening 18 for the compressed air 16, which is directed toward the folding table 6.

The folding table 6 forms a gathering device 6' for successively arriving printed sheets $\mathbf{2}_{1 \ldots n}$. An end stop 19 that can be adjusted to the format of the printed sheets $\mathbf{2}_{1 \ldots n}$ is arranged in the region of the folding table 6 for the front edges $\mathbf{2}_{1' \ldots n'}$, of the gathered printed sheets $\mathbf{2}_{1 \ldots n}$ resting on the folding table 6, the printed sheets $\mathbf{2}_1$, $\mathbf{2}_2$ and $\mathbf{2}_3$ in this case. For this, the end stop 19 is connected to a first adjusting device 20.

Referring further to FIG. 2, the two folding rollers 9, 10 are respectively provided with a rotational axis 9', 10', oriented parallel or nearly parallel to each other and parallel to the folding table 6. The folding rollers 9, 10 are positioned on opposite ends 21, 22, respectively in separate bearing locations 23, 24 (FIG. 2). They are arranged spaced-apart and transverse to the conveying direction 4 and thus have a folding roller gap 25 between them for accommodating and further moving the printed sheets $\mathbf{2}_{1 \ldots n}$ to be folded. The orientation of the rotational axes 9', 10' of the folding rollers 9, 10, relative to each other, and thus also the folding roller gap 25 that forms can be varied, depending on the thickness of the printed sheets $\mathbf{2}_{1 \ldots n}$ gathered and resting on the folding table 6, meaning corresponding to the folding pattern used and/or the type of paper used. The folding table 6 has a recess 6" above the folding roller gap 25 through which the printed sheets $\mathbf{2}_{1 \ldots n}$ to be folded can pass. The folding rollers 9, 10 are furthermore driven counter-rotating, relative to each other, and are connected to a drive motor 26 (FIG. 1). Finally, a second adjusting device 27 for changing the spacing between the folding rollers 9, 10 is arranged on both sides at the bearing locations 23, 24 for the folding rollers 9, 10, which serves to adjust the folding roller gap 25 and/or its gap width 25'. As an alternative, the bearing locations 23, 24 can also be spring operated.

Referring further to FIG. 3, to press down one back edge $\mathbf{2}_{1'' \ldots n''}$ of a printed sheet $\mathbf{2}_{1 \ldots n}$ to be positioned on the folding table 6 in the direction of the folding table 6, several pressing-down mechanisms 29 are arranged spaced apart in conveying direction 4 above the folding table 6, in its upstream region 28. The pressing-down mechanisms 29 are furthermore arranged transverse to the conveying direction 4 of the printed sheets $\mathbf{2}_{1 \ldots n}$, at a side distance 30 to an upstream end 15' of the compressed air device 15 for the folding sword 7. This side distance 30 can be adjusted via a third adjusting device 31, indicated only by double arrow herein (FIG. 2). The pressing-down mechanisms 29 are connected to a second compressed-air source 14' and are respectively provided with at least one exit opening 32 for compressed air 33 (FIG. 1, FIG. 2,), which is focused onto the folding table 6 and/or onto the top side $\mathbf{2}_{1''' \ldots n'''}$ of the printed sheet $\mathbf{2}_{1 \ldots n}$ to be positioned on the folding table 6. To brake the printed sheet $\mathbf{2}_{1 \ldots n}$ approximately at the same time as pressing down the back edge $\mathbf{2}_{1' \ldots n''}$, the pressing-down mechanisms 29 are provided with a mechanical braking element 34 for this printed sheet $\mathbf{2}_{1 \ldots n}$, which is arranged between the at least one first exit opening 32 for compressed air 33 and the folding table 6 and acts in the region of the back edge $\mathbf{2}_{1'' \ldots n''}$ onto the top side $\mathbf{2}_{1''' \ldots n''}$ of the printed sheet $\mathbf{2}_{1 \ldots n}$ to be positioned on the folding table 6. Depending on the requirement, only a single pressing-down mechanism 29 can also be used which is then arranged centrally, as seen in the direction transverse to the conveying direction 4, meaning essentially in the vertical plane through the folding sword 7.

The apparatus 1 comprises a machine control 35 which is operatively connected to the folding sword 7 and the pressing-down mechanisms 29. To activate the folding sword 7 and the pressing-down mechanisms 29, corresponding control lines 36 with magnetic valves 37 are provided. At least one sensor 38 that is operatively connected to the machine control 35 is arranged in the region of the conveyor 3 for detecting the printed sheets $\mathbf{2}_{1 \ldots n}$ transported with the conveyor 3. The sensor 38 is connected for this to the machine control 35 via a data line 39. As shown in FIG. 2, at least two sensors 38 may be positioned, spaced-apart and transverse to the conveying direction, for detecting the printed sheets transported with the conveyor. Each sensor 38 is operatively connected to the machine control by a data line 39, thus making it possible to identify a possible slanted positioning of a transported printed sheet and, for example, correcting this problem through correspondingly admitting the segments of the sword 7 or the pressing-down mechanism 29 with compressed air.

FIG. 2 shows a simplified, schematic view from the front of the apparatus 1 according to FIG. 1, shown counter to the conveying direction 4 for the printed sheets $\mathbf{2}_{1 \ldots n}$. In particular shown herein are the holding element 7' for the folding sword 7, the individual belt sections of the lower belt 11 on the conveyor 3, which are embedded in the folding table 6, the gap width 25' of the folding roller gap 25, as well as the side distance 30 for the respective pressing-down mechanism 29, relative to the compressed-air device 15 on the folding sword 7.

During the operation of the apparatus 1, the front edge $\mathbf{2}_{1' \ldots n'}$ of a following printed sheet $\mathbf{2}_{1 \ldots n}$, meaning in FIG. 1 the printed sheet 24, is supplied while raised as compared to the back edge $\mathbf{2}_{1'' \ldots n''}$ of the printed sheet $\mathbf{2}_{1 \ldots n}$ positioned on the folding table 6, meaning in FIG. 1 the printed sheet 23. This can be achieved with a fixed or adjustable section 40 in the lower belt 11 (FIG. 1, FIG. 2), shown herein, with the aid of an active element that is not shown or a ramp which is also not shown, for lifting up the front edge $\mathbf{2}_{1' \ldots n'}$ of the following printed sheet $\mathbf{2}_{1 \ldots n}$ as compared to the back edge $\mathbf{2}_{1'' \ldots n''}$ of the printed sheet $\mathbf{2}_{1 \ldots n}$ positioned on the folding table 6.

Once a number of printed sheets $\mathbf{2}_{1 \ldots n}$ is gathered on the folding table 6 that forms the gathering device 6', meaning they have been deposited thereon to form a stack 41, this stack 41 is subsequently folded with the aid of the folding sword 7 and the folding roller pair 8, and a folded print product 41' is created (FIG. 3).

For this, the corresponding magnetic valves 37 of the folding sword 7 are initially opened with the machine control 35. Compressed air 16 then streams from the first compressed-air source 14 into the segments 17 of the compressed-air line 15. Coming from the outlet openings 18 of the segments 17, this compressed air 16 impinges on the stack 41, respectively the top side $\mathbf{2}_{1''' \ldots n'''}$ of the upper printed sheet $\mathbf{2}_{1 \ldots n}$, and is focused in such a way that the stack 41 is pushed through the recess 6" in the folding table 6 and between the individual belt sections of the lower belt 11 into the folding roller gap 25 of the folding roller pair 8 and is finally folded with the aid of the folding rollers 9, 10. The impulse for opening the magnetic valves 37 and thus for folding the stack 41 is triggered only if the following printed sheet $\mathbf{2}_{1 \ldots n}$ has an overlap 42 (FIG. 1), as compared to the stack 41 resting on the folding table 6. On the one hand, this prevents a blocking of the feeding of the following printed sheet $\mathbf{2}_{1 \ldots n}$ into the clearance space between the stack 41 and the upper belt 12 when the stack 41 moves between the folding rollers 9, 10. On the other hand, the following printed sheet $\mathbf{2}_{1 \ldots n}$ functions as a guide for the ends of the printed sheet $\mathbf{2}_{1 \ldots n}$ of the stack 41 to be formed, which pass last through the folding rollers 9, 10. This avoids the forming of so-called dog ears, meaning where the ends are turned over in vertical direction because of the relatively high acceleration during the transport and are then bent over by the folding rollers 9, 10. The length for the overlapping 42 here is about 1 to 20% of the length of a printed sheet $\mathbf{2}_{1 \ldots n}$ in the stack 41.

Owing to the fact that the compressed-air device 15 for the folding sword 7 is divided into several segments 17, it is possible to admit only those segments 17 with compressed air 16 which are necessary for the corresponding format folding the printed sheets $\mathbf{2}_{1 \ldots n}$ and/or forming the stacks 41, meaning the segments 17 arranged in the region of stack 41. The segments 17 not needed and arranged outside of this region remain closed through non-activation of their magnetic valves 37. On the one hand, this saves compressed air 16 while, on the other hand, unused compressed air is prevented from entering the clearance space between the folding sword 7 and the stack 41 to be folded where it may result in eddying and hinder the concrete orientation of the upper printed sheet $\mathbf{2}_{1 \ldots n}$ in the stack 41.

The print product 41' that is produced through folding of the stack 41 is transported further to an intermediate storage location or to the post-processing via a transport device 44 that adjoins the folding roller pair 8 and consists, for example, of individual belt sections 43. If only the end stop 19 is adapted to the format of the printed sheets $\mathbf{2}_{1 \ldots n}$ which form a joint stack 41, the print product 41' is conveyed away off-center on the transport device 43, as shown in FIG. 3. On the other hand, if in addition to the end stop 19 the segment 40 and the pressing-down mechanisms 29 are moved in or counter to the conveying direction 4, the print product 41' can still be centrally transported on the transport device 43.

If printed sheets $\mathbf{2}_{1 \ldots n}$ having a larger or smaller format as compared to the current work order are to be processed with the apparatus 1, the end stop 19 can be moved via the first adjusting device 20 either in or counter to the conveying direction 4, so that these printed sheets $\mathbf{2}_{1 \ldots n}$ are also deposited successively one above the other on the folding table 6, functioning as gathering device 6', and a stack 41 is formed with these printed sheets $\mathbf{2}_{1 \ldots n}$. In addition, a corresponding adjustment of the step 40 and the pressing-down mechanism 29 in or counter to the conveying direction 4 can also take place.

As a result of the height-adjustable arrangement of the folding sword 7 on the holding element 7', the vertical distance between the folding sword 7 and the folding table 6 can correspondingly be adjusted for a following work order with different thicknesses for the stack 41 of printed sheets $\mathbf{2}_{1 \ldots n}$ to be folded. As a result, it is advantageously possible to adapt this vertical distance to the number of printed sheets to be folded and also to the type of paper used.

Since the stack forming occurs prior to the folding with this apparatus 1, the transport speed for the printed sheets $\mathbf{2}_{1 \ldots n}$ in the stack 41 can be reduced easily and cost-effectively as compared to the individually folded sheets according to the prior art. Depending on the post-processing machines used upstream of the apparatus 1, a lower number of cycles can thus be realized, which permits a more careful further processing while avoiding quality problems. Owing to the easy way of supplying previously non-folded printed sheets $\mathbf{2}_{1 \ldots n}$ to the folding table 6, the number of blank pages in the stack 41 and thus in the print product 41' can be reduced easily, as compared to the known prior art, without increasing the transport speed. As a result, quality problems can be avoided in the machines used for the further processing.

FIG. 3 shows a second exemplary embodiment of an inventive apparatus 1' for which the lower belt 11 and the upper belt 12 of the conveyor 3 respectively have two transport belt sections 11', 11", 12', 12" which are successively arranged in conveying direction 4, wherein more than two transport belt sections 11', 11", 12', 12" can also be arranged. As a result, the folding table 6, the folding sword 7 and the folding roller pair 8 of the apparatus 1' can advantageously be separated from the conveyor 3, meaning from the feeding of the printed sheets $\mathbf{2}_{1 \ldots n}$.

In contrast to the first exemplary embodiment, the compressed-air device 15 here is not embodied segmented, and the apparatus 1' can thus be produced even easier and more cost-effective. In the same way as the compressed-air device 15, the pressing-down mechanisms 29 here are also connected to the first compressed-air source 14, so that no second compressed-air source is advantageously needed. The upper belt 12 furthermore converges toward the lower belt 11 in the region of the folding table 6, meaning it is embodied with a converging conveying gap 13' in conveying direction 4, which additionally supports the guidance of the printed sheets $\mathbf{2}_{1 \ldots n}$ in the region of the folding table. Of course, the lower belt 11 can also converge toward the upper belt 12 or both belts 11, 12 can converge toward each other.

Also conceivable are inventive apparatuses and corresponding methods for which the different features of the first and second exemplary embodiment are combined in different ways.

It will be understood that the above description of the present invention is susceptible to various modifications, changes and adaptations, and that the same are intended to be comprehended within the meaning and range of equivalents of the appended claims.

What is claimed is:

1. An apparatus for the post-processing of successively following, sequentially printed sheets, comprising a conveyor for transporting printed sheets in a conveying direction;

a folding table, arranged in a downstream region of the conveyor, for accommodating the printed sheets, the folding table constructed and arranged as a gathering device for at least two successively following printed sheets;

a folding sword arranged at a vertical distance to the folding table, wherein the folding sword is arranged to be stationary and comprises a compressed-air device that is connectable to a first compressed air source and has at least one outlet opening a folding roller pair with an in-between arranged folding roller gap, the roller pair being arranged on a side of a folding table that is opposite a side on which the folding sword is located, wherein the outlet opening of the compressed air device is focused on the folding roller gap for introducing compressed air to fold the printed sheets;

at least one pressing-down mechanism, positioned above the folding table and in an upstream region of the folding table, for pressing down in the direction of the folding table a back edge of a printed sheet to be positioned on the folding table, wherein a front edge of a following printed sheet is supplied while raised up relative to the back edge of the printed sheet positioned on the folding table; and wherein the at least one pressing down mechanism includes at least one mechanical braking element for the printed sheets which acts upon a top side of at least one printed sheet to be positioned on the folding table;

a machine control operatively connected to the folding sword and the at least one pressing-down mechanism; and at least one sensor arranged in a region of the conveyor which cooperates with the machine control for detecting the printed sheets conveyed with the conveyor.

2. The apparatus according to claim 1, comprising an end stop arranged in a region of the folding table for stopping front edges of printed sheets gathered on the folding table.

3. The apparatus according to claim 2, wherein the end stop is movable in and counter to the conveying direction of the printed sheets.

4. The apparatus according to claim 1, wherein the at least one pressing-down mechanism is connectable to one of the first compressed-air source or a second compress-air source and includes at least one exit opening for compressed air which is focused onto a top side of a respective printed sheet to be positioned on the folding table, in a region of a back edge of the respective printed sheet.

5. The apparatus according to claim 4, wherein the at least one mechanical braking element is arranged between the at least one exit opening of the pressing-down mechanism and the folding table.

6. The apparatus according to claim 1, comprising at least two separate pressing-down mechanisms which are respectively arranged transverse to the conveying direction for the printed sheets at a distance to a side from an upstream end of the compressed-air device for the folding sword.

7. The apparatus according to claim 6, wherein the distance to the side of the at least two separate pressing-down mechanisms is adjustable.

8. The apparatus according to one of the claim 1, wherein the folding sword comprises a plurality of segments arranged successively in the conveying direction.

9. The apparatus according to claim 1, wherein the conveyor comprises a lower belt and an upper belt cooperating with the lower belt for transport of the printed sheets.

10. The apparatus according to claim 9, wherein the lower belt and the upper belt extend into a region of the folding table.

11. The apparatus according to claim 10, wherein the lower belt and/or the upper belt are arranged to converge toward each other in the region of the folding table.

12. The apparatus according to claim 1, wherein the at least one sensor comprises at least two sensors in a region of the conveyor, wherein the at least two sensors are operatively connected to the machine control for detecting the printed sheets transported by the conveyor and are arranged spaced-apart transverse to the conveying direction.

13. The apparatus according to claim 1, wherein the folding roller pair and the folding sword are arranged in one of a longitudinal direction of the conveying direction or a cross direction to the conveying direction.

14. The apparatus according to claim 1, wherein the folding roller gap has a gap width that is adjustable.

15. A method for post-processing of successively following, sequentially printed sheets, comprising:

transporting by a conveyor the successively following, sequentially printed sheets in a conveying direction to a folding table arranged in a downstream region of the conveyor;

depositing the transported printed sheets on the folding table;

operating jointly for folding the printed sheets a folding sword positioned at a vertical distance to the folding table and a folding roller pair with an in-between formed folding gap positioned on a side of the folding table that is located opposite the folding sword, wherein the folding sword is stationary and includes at least one outlet opening for blowing compressed air;

pressing down a back edge of a preceding printed sheet to be positioned on the folding table with at least one pressing-down mechanism in a direction of the folding table for braking the preceding printed sheet, wherein the pressing down mechanism includes a mechanical braking element making contact with a top side of the preceding printed sheet in a region of a back edge of the preceding printed sheet;

supplying a following printed sheet with a front edge of the following printed sheet raised up, relative to the back edge of the preceding printed sheet positioned on the folding table;

controlling the pressing-down mechanism and the folding sword via a machine control;

gathering at least two successively following printed sheets on a gathering device of the folding table to form a joint stack;

folding the joint stack into a print product by compressed air from a first compressed-air source blown onto the joint stack through the at least one outlet opening in the stationary folding sword;

detecting a printed sheet transported with the conveyor by a sensor which is operatively connected to the machine control;

computing with the machine control corresponding control signals based on information obtained from the sensor for pressing down the back edge of the preceding printed sheet with the pressing down mechanism for braking the printed sheet by the mechanical braking element and for triggering activation of the folding sword for carrying out the folding step; and triggering the pressing down, braking, and folding with the control signals.

16. The method according to claim 15, comprising conveying the front edges of the printed sheets to be gathered on the folding table against an end stop arranged in a region of the folding table.

17. The method according to claim 16, comprising displacing the end stop either in or counter to the conveying direction for the printed sheets in when there is a changed format for the printed sheets to be gathered on the folding table.

18. The method according to claim 15, comprising supplying the at least one pressing-down mechanism with compressed air from the first compressed-air source or from a second compressed-air source; wherein the pressing down step includes blowing out the compressed air through at least one exit opening of the pressing-down mechanism in a region of the back edge and onto the top side of the printed sheets to be positioned on the folding table.

19. The method according to claim 15, wherein the pressing down includes conducting the compressed air blowing out of at least one exit opening of the pressing-down mechanism onto the at least one mechanical braking element to deflect the at least one mechanical braking element in the direction of the folding table and bringing the at least one mechanical braking element into contact with the printed sheet to be positioned on the folding table or to be supplied to the joint stack.

20. The method according to claim 15, wherein the pressing down includes blowing the compressed air out via at least two separate pressing-down mechanisms which are respectively arranged transverse to the conveying direction for the printed sheets at a distance to a side from an upstream end of a compressed-air device of the folding sword.

21. The method according to claim 20, comprising correspondingly reducing or increasing the side distance of the at least two separate pressing-down mechanisms for a following order to process printed sheets having a smaller or larger format, respectively.

22. The method according to claim 15, comprising: introducing the compressed air supplied by the first compressed-air source into a plurality of segments of the folding sword, arranged successively in the conveying direction; and admitting, under control of the machine control, compressed air to only the segments of the folding sword positioned in a region of the joint stack.

23. The method according to claim 15, comprising transporting the printed sheets to the folding table in a conveying gap formed between a lower belt and an upper belt of the conveyor.

24. The method according to claim 23, comprising transporting the printed sheets with aid of the lower belt and the upper belt of the conveyor into a region of the folding table.

25. The method according to claim 24, wherein the lower belt and the upper belt converge toward each other and further comprising guiding the printed sheets in the region of the folding table between the converging lower belt and/or the upper belt.

26. The method according to claim 15, wherein the detecting step includes detecting the printed sheets in the region of the conveyor with aid of at least two spaced-apart sensors arranged transverse to the conveying direction and operatively connected to the machine control.

27. The method according to claim 15, wherein the folding includes folding the joint stack in a longitudinal or cross direction to the conveying direction of the printed sheets transported with the conveyor.

28. The method according to claim 15, comprising correspondingly adjusting a gap width of the folding roller gap for a following processing order with different thickness of the joint stack to be folded.

* * * * *